US010977992B2

(12) United States Patent
Lin et al.

(10) Patent No.: US 10,977,992 B2
(45) Date of Patent: Apr. 13, 2021

(54) CIRCUIT DRIVE COMPENSATION METHOD, CIRCUIT DRIVE METHOD AND DEVICE, AND DISPLAY DEVICE

(71) Applicant: BOE TECHNOLOGY GROUP CO., LTD., Beijing (CN)

(72) Inventors: Yicheng Lin, Beijing (CN); Yu Wang, Beijing (CN); Ling Wang, Beijing (CN); Pan Xu, Beijing (CN); Cuili Gai, Beijing (CN); Baoxia Zhang, Beijing (CN); Guang Yan, Beijing (CN); Dongfang Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/624,276

(22) PCT Filed: Nov. 30, 2018

(86) PCT No.: PCT/CN2018/118734
§ 371 (c)(1),
(2) Date: Dec. 18, 2019

(87) PCT Pub. No.: WO2019/114573
PCT Pub. Date: Jun. 20, 2019

(65) Prior Publication Data

US 2020/0118489 A1 Apr. 16, 2020

(30) Foreign Application Priority Data

Dec. 13, 2017 (CN) ..... 201711331651.9

(51) Int. Cl.
*G09G 3/3233* (2016.01)

(52) U.S. Cl.
CPC ... *G09G 3/3233* (2013.01); *G09G 2300/0819* (2013.01); *G09G 2320/0233* (2013.01); *G09G 2360/145* (2013.01)

(58) Field of Classification Search
CPC ..... G09G 3/3291; G09G 3/3233; G09G 2300/0426; G09G 2300/0819; H01L 2924/00
See application file for complete search history.

(56) References Cited

U.S. PATENT DOCUMENTS 9,167,635 B2 10/2015 Yamashita et al.
9,824,634 B2 11/2017 Miwa et al.
(Continued)

FOREIGN PATENT DOCUMENTS

CN 102074189 A 5/2011
CN 102138172 A 7/2011
(Continued)

OTHER PUBLICATIONS

Chinese Office Action dated Mar. 16, 2020, from application No. 201711331651.9.
(Continued)

*Primary Examiner* — Robert J Michaud
(74) *Attorney, Agent, or Firm* — Thomas|Horstemeyer LLP

(57) ABSTRACT

A driving compensation method for a pixel circuit includes: in a compensation phase of the pixel circuit, providing a preset signal to the control terminal of the driving transistor to write the preset signal to the control terminal of the driving transistor, to write internal loss voltage of the driving transistor to the first terminal of the driving transistor; wherein the compensation phase includes a first external compensation phase and a second external compensation phase; in the first external compensation phase, the preset
(Continued)

signal is a sum of a reference signal and a threshold voltage of the driving transistor; in the second external compensation phase, the preset signal is the sum of the data signal and the threshold voltage of the driving transistor.

12 Claims, 5 Drawing Sheets

(56) References Cited

U.S. PATENT DOCUMENTS

| | | | | |
|---|---|---|---|---|
| 2014/0078233 | A1 | 3/2014 | Yamashita et al. | |
| 2016/0125787 | A1* | 5/2016 | Pyeon | G09G 3/2055 345/691 |
| 2016/0189623 | A1 | 6/2016 | Miwa et al. | |
| 2017/0110055 | A1 | 4/2017 | Li et al. | |
| 2018/0218681 | A1 | 8/2018 | Cai | |
| 2019/0074340 | A1* | 3/2019 | Cai | G09G 3/3266 |

FOREIGN PATENT DOCUMENTS

| | | | |
|---|---|---|---|
| CN | 104751804 | A | 7/2015 |
| CN | 105761678 | A | 7/2016 |
| CN | 106205495 | A | 12/2016 |
| CN | 106856086 | A | 6/2017 |
| CN | 106935192 | A | 7/2017 |
| CN | 107342052 | A | 11/2017 |
| EP | 3 040 971 | A1 | 7/2016 |
| EP | 3 040 971 | B1 | 8/2017 |
| WO | WO-2018/205658 | A1 | 11/2018 |

OTHER PUBLICATIONS

International Search Report and Written Opinion dated Mar. 5, 2019, from application No. PCT/CN2018/118734.

* cited by examiner

CIRCUIT DRIVE COMPENSATION METHOD, CIRCUIT DRIVE METHOD AND DEVICE, AND DISPLAY DEVICE

CROSS-REFERENCE TO RELATED APPLICATIONS

This application is based on International Application No. PCT/CN2018/118734, filed on Nov. 30, 2018, which claims the priority of Patent Application No. CN201711331651.9, entitled "CIRCUIT DRIVE COMPENSATION METHOD, CIRCUIT DRIVE METHOD AND DEVICE, AND DISPLAY DEVICE," filed on Dec. 13, 2017, and the entire contents thereof are incorporated herein by reference.

TECHNICAL FIELD

The present disclosure relates to the field of display technologies, and in particular, to a circuit drive compensation method, a circuit drive method and a circuit drive device, and a display device.

BACKGROUND

As a current-type light-emitting device, Organic Light Emitting Diode (OLED) is increasingly used in the field of high performance display due to its characteristics of self-illumination, fast response, wide viewing angle and its ability to be fabricated on flexible substrates. OLED display devices can be classified into two types: PMOLED (Passive Matrix Driving OLED) and AMOLED (Active Matrix Driving OLED) according to the different driving methods. AMOLED has gained increasing attention from display technology developers due to its advantages of low manufacturing cost, high response speed, power saving, DC drive for portable devices, and large operating temperature range.

In the existing AMOLED display panel, each OLED relies on a pixel circuit corresponding to each OLED on the array substrate to drive it to emit light to implement displaying.

However, in the pixel circuit, the mobility of the driving transistor, the threshold voltage, the resistance on the wire, and the like may cause the driving currents driving the OLEDs to be inconsistent, thus causing the uneven brightness of the display panel.

It should be noted that the information disclosed in the Background section above is only for enhancement of understanding of the background of the present disclosure, and thus may include information that does not constitute prior art known to those of ordinary skill in the art.

SUMMARY

The present disclosure is directed to providing a driving compensation method for a pixel circuit, a driving method for a pixel circuit, a driving device for a pixel circuit, and a display device, to overcome at least to some extent one or more problems due to limitations and disadvantages of the related art.

According to an aspect of the present disclosure, a driving compensation method for a pixel circuit is provided. The pixel circuit including a driving transistor. The method includes in a compensation phase of the pixel circuit, providing a preset signal to a control terminal of the driving transistor to write the preset signal to a control terminal of the driving transistor, and writing an internal loss voltage of the driving transistor to a first terminal of the driving transistor. The compensation phase includes a first external compensation phase and a second external compensation phase. In the first external compensation phase, the preset signal is a sum of a reference signal and a threshold voltage of the driving transistor. In the second external compensation phase, the preset signal is a sum of a data signal and a threshold voltage of the driving transistor.

In an example arrangement of the present disclosure, the method further includes in a reset phase of the pixel circuit, providing the preset signal to the control terminal of the driving transistor to reset the control terminal of the driving transistor and providing a reset signal to the first terminal of the driving transistor to reset the first terminal of the driving transistor. The preset signal is the sum of the reference signal and the threshold voltage of the driving transistor.

In an example arrangement of the present disclosure, the method further includes in a light emitting phase of the pixel circuit, when the driving transistor is turned on under the action of the data signal and the threshold voltage of the driving transistor and the internal loss voltage, outputting a driving current under the action of a first power signal of the pixel circuit to drive an electroluminescent element to emit light.

In an example arrangement of the present disclosure, the method further includes in a sensing phase of the pixel circuit, extracting a current signal flowing through the driving transistor with a sensing line of the pixel circuit, and based on the current signal flowing through the driving transistor, calculating the threshold voltage of the driving transistor with an external electrical compensation circuit.

In an example arrangement of the present disclosure, the method further includes in a sensing phase of the pixel circuit, extracting a current signal flowing through the electroluminescent element with a sensing line of the pixel circuit, and based on the current signal flowing through the electroluminescent element, calculating the threshold voltage of the driving transistor with an external electrical compensation circuit.

In an example arrangement of the present disclosure, the method further includes in a sensing phase of the pixel circuit, obtaining a brightness value of an electroluminescent element with an external optical compensation circuit, and calculating the threshold voltage of the driving transistor according to the brightness value of the electroluminescent element.

In an example arrangement of the present disclosure, when the threshold voltage of the driving transistor remains unchanged between the first external compensation phase and the second external compensation phase, a mobility compensation voltage of the driving transistor is determined as the internal loss voltage.

In an example arrangement of the present disclosure, when the threshold voltage of the driving transistor changes between the first external compensation phase and the second external compensation phase, a mobility compensation voltage of the driving transistor and an amount of change in the threshold voltage of the driving transistor are determined as the internal loss voltage.

According to an aspect of the present disclosure, a driving method for a pixel circuit is provided, for providing a preset signal to a control terminal of a driving transistor in a pixel circuit. The method includes: providing a reference signal and a data signal; and generating the preset signal according to the reference signal, the data signal, and a threshold voltage of the driving transistor. In a first external compensation phase of the pixel circuit, the preset signal is a sum of the threshold voltage of the driving transistor and the reference signal, in a second external compensation phase of the pixel circuit, the preset signal is a sum of a threshold voltage of the driving transistor and the data signal.

In an example arrangement of the present disclosure, the method further includes in a sensing phase of the pixel circuit, obtaining the threshold voltage of the driving transistor from an external compensation circuit.

In an example arrangement of the present disclosure, the external compensation circuit includes an external electrical compensation circuit and an external optical compensation circuit.

According to an aspect of the present disclosure, a driving device for a pixel circuit is provided, for providing a preset signal to a control terminal of a driving transistor in a pixel circuit. The driving device includes: a supplying circuit configured to provide a reference signal and a data signal, and a generating circuit configured to generate the preset signal according to the reference signal, the data signal, and a threshold voltage of the driving transistor. In a first external compensation phase of the pixel circuit, the preset signal is a sum of the threshold voltage of the driving transistor and the reference signal. In a second external compensation phase of the pixel circuit, the preset signal is a sum of the threshold voltage of the driving transistor and the data signal.

According to an aspect of the present disclosure, a display device including the driving device for a pixel circuit according to any of the above.

It should be noted that the information disclosed in the Background section above is only for enhancement of understanding of the background of the present disclosure, and thus may include information that does not constitute prior art known to those of ordinary skill in the art.

BRIEF DESCRIPTION OF THE DRAWINGS

The accompanying drawings described herein are intended to provide a further understanding of the present disclosure, and are intended to be a part of the present disclosure. The illustrative arrangements of the present disclosure and the description thereof are for explaining the present disclosure and do not constitute an undue limitation of the present disclosure. In the drawing.

DETAILED DESCRIPTION

Figure 1:
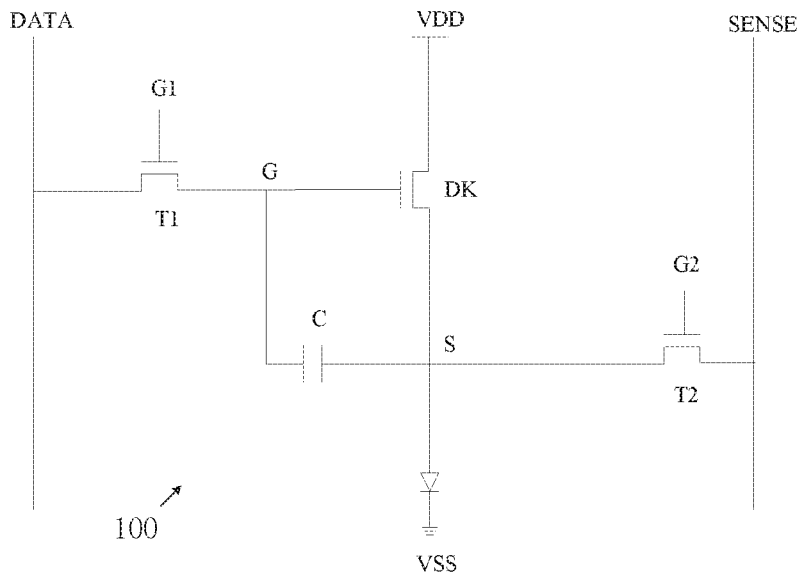
FIG. 1 is a schematic diagram of a 3T1C pixel circuit according to an example arrangement of the present disclosure.

Example arrangements will now be described more fully with reference to the accompanying drawings. However, the example arrangements can be embodied in a variety of forms and should not be construed as being limited to the arrangements set forth herein. Rather, these arrangements are provided to make the present disclosure more thorough and complete, and to fully convey the concept of the example arrangements to those skilled in the art. The described features, structures, or characteristics may be combined in any suitable manner in one or more arrangements. In the following description, numerous specific details are set forth to provide thorough understanding of the arrangements of the present disclosure. However, one skilled in the art will appreciate that the technical solution of the present disclosure may be practiced without one or more of the specific details, or other methods, components, materials, devices, blocks, etc. may be employed. In other instances, well-known technical solutions are not shown or described in detail to avoid obscuring aspects of the present disclosure.

In addition, the drawings are merely schematic illustrations of the present disclosure, and are not necessarily drawn to scale. The same reference numerals in the drawings denote the same or similar parts, and the repeated description thereof will be omitted.

A driving compensation method for a pixel circuit is provided in an example arrangement. The pixel circuit includes a driving transistor which may be an N-type transistor or a P-type transistor. The pixel circuit compensation method may include: providing a preset signal to a control terminal of the driving transistor in a compensation phase of the pixel circuit to write the preset signal to a control terminal of the driving transistor, and writing an internal loss voltage of the driving transistor to a first terminal of the driving transistor. The compensation phase includes a first external compensation phase and a second external compensation phase; and in the first external compensation phase, the preset signal is a sum of a reference signal and a threshold voltage of the driving transistor; in the second external compensation phase, the preset signal is a sum of a data signal and a threshold voltage of the driving transistor.

In a driving compensation method for a pixel circuit provided by an example arrangement of the present disclosure, on the one hand, since in the first external compensation phase, the preset signal is the sum of the reference signal and the threshold voltage of the driving transistor, and in the second external compensation phase, the preset signal is the sum of the data signal and the threshold voltage of the driving transistor. That is, the reference signal and the data signal are respectively corrected by the threshold voltage of the driving transistor, to write the threshold voltage of the driving transistor to the control terminal of the driving transistor through an external compensation manner. Thus it can eliminate the influence of the threshold voltage of the driving transistor on the current of the driving transistor, and ensure the uniformity of the brightness of each pixel display. On the other hand, in the first external compensation phase, the voltage of the control terminal of the driving transistor maintains the sum of the reference signal and the threshold voltage of the driving transistor for a period of time, to raise the voltage of the first terminal of the driving transistor for the first time. When the second external compensation phase arrives, the voltage of the control terminal of the driving transistor is changed from the sum of the reference signal and the threshold voltage of the driving transistor to the sum of the data signal and the threshold voltage of the driving transistor, to raise the voltage of the first terminal of the driving transistor for the second time based on the raise of the first time. During the entire compensation phase, the voltage of the first terminal of the driving transistor is raised twice. Thus the internal compensation range can be expanded, and the problem of insufficient charging time of the data signal can also be avoided. Lastly, in the compensation phase, through the sum of the reference signal provided to the control terminal of the driving transistor and the threshold voltage of the driving transistor and the sum of the data signal and the threshold voltages of the driving transistor, the internal loss voltage can be written to the first terminal of the driving transistor to eliminate the influence of internal loss on the current of the driving transistor, and ensure the uniformity of display brightness of each pixel.

FIG. 1 is a schematic diagram of a 3T1C pixel circuit 100 corresponding to the driving compensation method for a pixel circuit. The 3T1C pixel circuit includes a driving transistor DK, a capacitor C, and an electroluminescent element OLED connected to the driving transistor DK. The driving transistor DK has a control terminal G connected to a data line DATA through a first switching transistor T1, a first terminal S connected to a reset line SENSE through a second switching transistor T2, and a second terminal connected to a first power signal VDD. The electroluminescent element OLED has a first electrode connected to the first terminal S of the driving transistor DK, and a second electrode connected to a second power signal VSS. The two terminals of the capacitor C are respectively connected to the control terminal G and the first terminal S of the driving transistor DK. A control terminal G of the first switching transistor T1 receives a first scan signal G1, and a control terminal G of the second switching transistor T2 receives a second scan signal G2. The data line DATA is used to provide a preset signal, and the reset line SENSE is used to provide a reset signal VL.

It should be noted that, in the 3T1C pixel circuit in FIG. 1, the transistors may be P-type transistors or N-type transistors, and all of the transistors may be enhancement transistors or depletion transistors, which is not particularly limited herein. Further, the 3T1C pixel circuit shown in FIG. 1 is only one of a plurality of pixel circuits corresponding to the driving compensation method for a pixel circuit.

Figure 2:
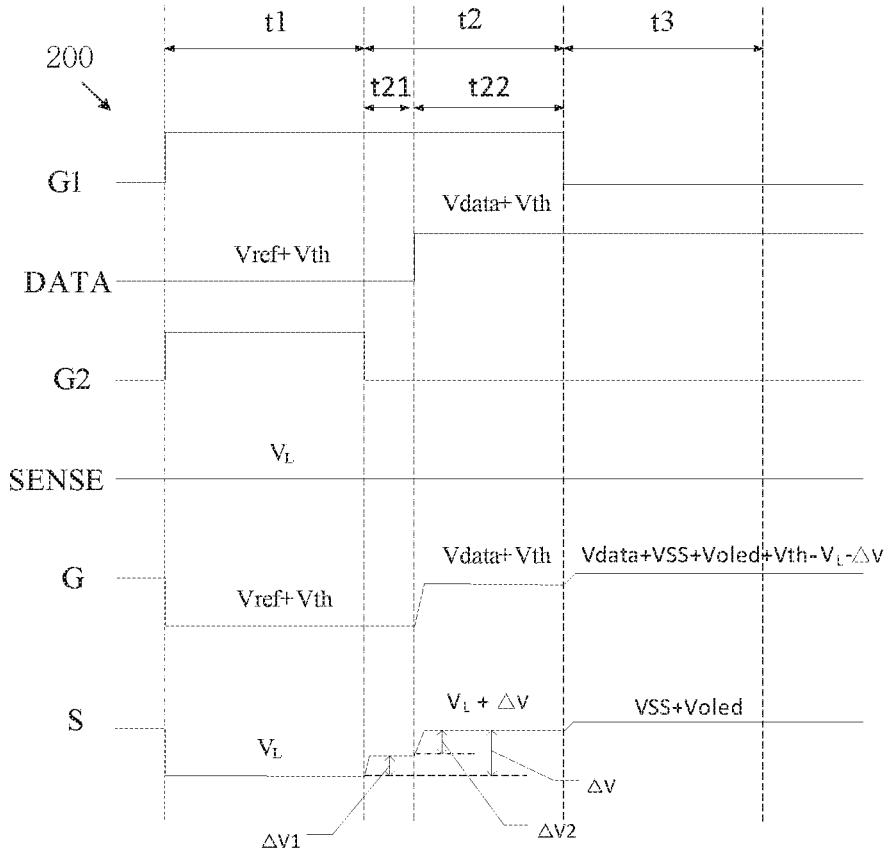
FIG. 2 is an operational timing chart of a 3T1C pixel circuit according to an example arrangement of the present disclosure.

Hereinafter, the driving compensation method for a pixel circuit will be described by taking the 3T1C pixel circuit shown in FIG. 1 and the transistors in the 3T1C pixel circuit being N-type transistors as an example and in conjunction with the operation timing chart 200 of the 3T1C pixel circuit shown in FIG. 2. It should be noted that when the transistors are all N-type transistors, each transistor is turned on at a high level and turned off at a low level, the first power signal VDD is at a high level, and the second power signal VSS is at a low level. The first electrode of the electroluminescent element OLED is an anode, and the second electrode of the electroluminescent element OLED is a cathode.

Figure 3:
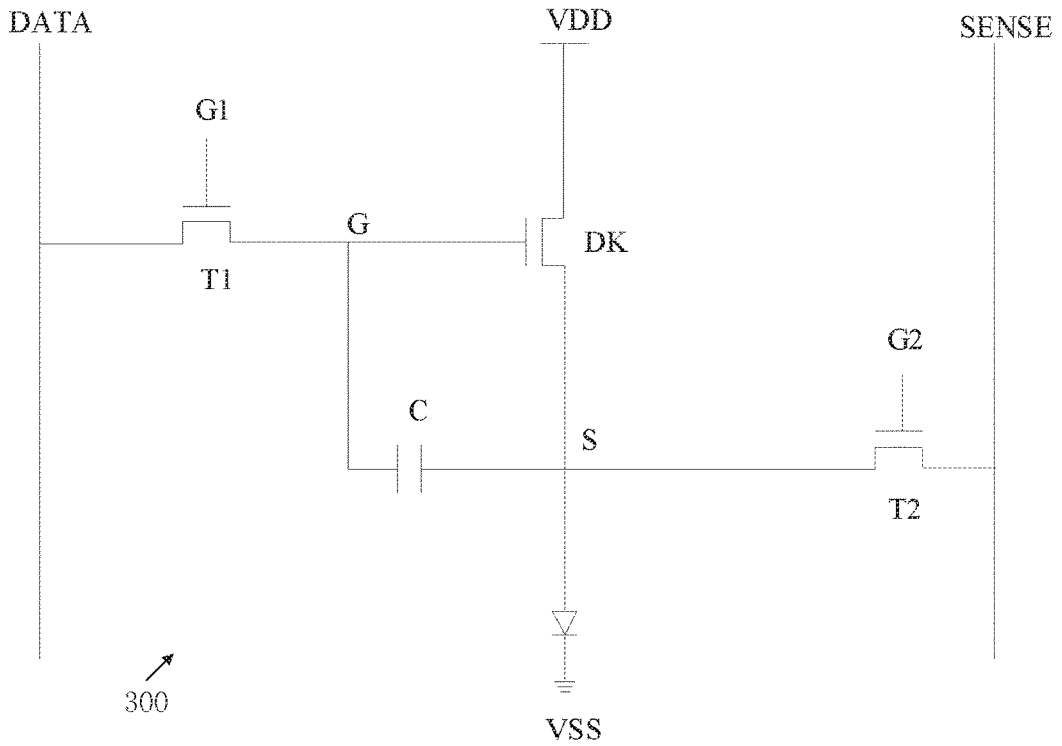
FIG. 3 is an equivalent circuit diagram of a 3T1C pixel circuit in a reset phase according to an example arrangement of the present disclosure.

In a reset phase (i.e., a phase t1) of the pixel circuit, the preset signal is provided to the control terminal G of the driving transistor DK to reset the control terminal G of the driving transistor DK and a reset signal VL is provided to the first terminal S of the driving transistor DK to reset the first terminal S of the driving transistor DK. The preset signal is the sum of the reference signal Vref and the threshold voltage Vth of the driving transistor DK. In the example arrangement of the present disclosure, the first scan signal G1 and the second scan signal G2 are both at a high level. As shown in 300 of FIG. 3, the first switching transistor T1 and the second switching transistor T2 are both turned on, and the preset signal provided by the data line DATA is transmitted to the control terminal G of the driving transistor DK through the first switching transistor T1. Since in the reset phase (i.e., the phase t1), the preset signal is the sum of the reference signal Vref and the threshold voltage Vth of the driving transistor DK. Therefore, the voltage of the control terminal G of the driving transistor DK becomes Vref+Vth, that is, the voltage of the control terminal G of the driving transistor DK is reset to Vref+Vth. The reset signal VL provided by the reset line SENSE is transmitted to the first terminal S of the driving transistor DK through the second switching transistor T2 to reset the first terminal S of the driving transistor DK. As can be seen from the above, by resetting the control terminal G and the first terminal S of the driving transistor DK, the influence of the previous frame of signal can be eliminated.

Figure 4:
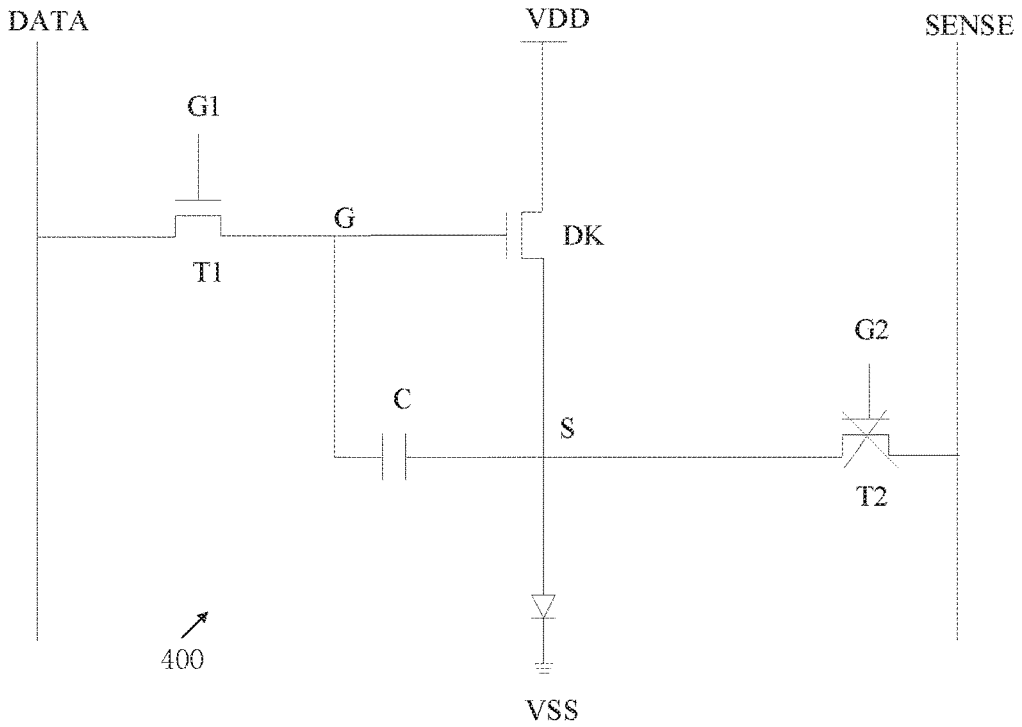
FIG. 4 is an equivalent circuit diagram of a 3T1C pixel circuit in a compensation phase according to an example arrangement of the present disclosure.

In a compensation phase (i.e., a phase t2) of the pixel circuit, a preset signal is provided to the control terminal G of the driving transistor DK to write the preset signal to the control terminal G of the driving transistor DK, and to write internal loss voltage of the driving transistor DK to the first terminal S of the driving transistor DK. The compensation phase (i.e., the phase t2) may include a first external compensation phase (i.e., a phase t21) and a second external compensation phase (i.e., a phase t22); in the first external compensation phase (i.e., the phase t21), the preset signal is a sum of a reference signal Vref and a threshold voltage Vth of the driving transistor DK. In the second external compensation phase (i.e., the phase t22), the preset signal is the sum of the data signal Vdata and the threshold voltage Vth of the driving transistor DK. In the example arrangement of the present disclosure, the first scan signal G1 is at a high level, and the second scan signal G2 is at a low level. As shown in 400 of FIG. 4, the first switching transistor T1 is turned on, and the second switching transistor T2 is turned off, and the preset signal provided by the data line DATA is transmitted to the control terminal G of the driving transistor DK through the first switching transistor T1, to write the preset signal to the control terminal G of the driving transistor DK, and to write the internal loss voltage of the driving transistor DK to the first terminal S of the driving transistor DK.

Specifically, the compensation phase (i.e., the phase t2) may include a first external compensation phase (i.e., the phase t21) and a second external compensation phase (i.e., the phase t22).

In the first external compensation phase (i.e., the phase t21), the preset signal is the sum of the reference signal Vref and the threshold voltage Vth of the driving transistor DK, and at this time, the voltage of the control terminal G of the driving transistor DK is changed to Vref+Vth. Since the second switching transistor T2 is turned off, the preset signal (Vref+Vth) charges the first terminal S of the driving transistor DK through the driving transistor DK, so that the voltage of the first terminal S of the driving transistor DK is raised by ΔV1 for the second time based on the original voltage.

In the second external compensation phase (i.e., the phase t22), the preset signal is the sum of the data signal Vdata and the threshold voltage Vth of the driving transistor DK. At this time, the voltage of the control terminal G of the driving transistor DK is changed to Vdata+Vth. Since the second switching transistor T2 is turned off, the preset signal (Vdata+Vth) charges the first terminal S of the driving transistor DK through the driving transistor DK, so that the voltage of the first terminal S of the driving transistor DK is raised by ΔV2 for the second time based on the raise of the first time.

During the entire compensation phase, the voltage of the first terminal S of the driving transistor DK is raised twice, that is, the total raised voltage of the first terminal S of the driving transistor DK is ΔV=ΔV1+ΔV2 during the entire compensation phase. Thus the internal compensation range can be expanded, and the problem of insufficient charging time of the data signal Vdata can also be avoided. Further, in the compensation phase, through the sum of the reference signal Vref provided to the control terminal G of the driving transistor DK and the threshold voltage Vth of the driving transistor DK and the sum of the data signal Vdata and the threshold voltages Vth of the driving transistor DK, the internal loss voltage (i.e. ΔV) can be written to the first terminal S of the driving transistor DK to eliminate the influence of internal loss on the current of the driving transistor DK, and ensure the uniformity of display brightness of each pixel. In addition, in the first external compensation phase, the preset signal is the sum of the reference signal Vref and the threshold voltage Vth of the driving transistor DK, and in the second external compensation phase, the preset signal is the sum of the data signal Vdata and the threshold voltage Vth of the driving transistor DK, that is, the reference signal Vref and the data signal Vdata are respectively corrected by the threshold voltage Vth of the driving transistor DK, to write the threshold voltage Vth of the driving transistor DK to the control terminal G of the driving transistor DK through an external compensation manner, thus it can eliminate the influence of the threshold voltage of the driving transistor on the current of the driving transistor, and ensure the uniformity of the brightness of each pixel display.

It should be noted that the total voltage ΔV=ΔV1+ΔV2 by which the voltage of the first terminal S of the driving transistor DK is raised during the two times of external compensation is the internal loss voltage.

In the example arrangement of the present disclosure, when the threshold voltage Vth of the driving transistor DK remains unchanged between the first external compensation phase and the second external compensation phase, the mobility compensation voltage of the driving transistor DK is determined as the internal loss voltage. Based on this, each of ΔV1 and ΔV2 by which the voltage is respectively raised in the first external compensation phase and the second external compensation phase is the mobility compensation voltage of the driving transistor DK. That is, the mobility compensation voltage of the driving transistor DK is compensated for in the first external compensation phase, and when the compensation on the mobility compensation voltage of the driving transistor DK is not completed for in the first external compensation phase, the mobility compensation voltage of the driving transistor DK is further compensated for in the second external compensation phase until the compensation on the mobility compensation voltage of the driving transistor DK is completed. It should be noted that, when the compensation on the mobility compensation voltage of the driving transistor DK is completed in the first external compensation phase, the sum of the data signal Vdata and the threshold voltage Vth of the driving transistor DK is only converted in the second external compensation phase.

When the threshold voltage Vth of the driving transistor DK changes between the first external compensation phase and the second external compensation phase, the mobility compensation voltage of the driving transistor DK and the amount of change in the threshold voltage Vth of the driving transistor DK are determined as the internal loss voltage. The mobility compensation voltage is positively correlated with the mobility of the driving transistor DK. Based on this, each of ΔV1 and ΔV2 by which the voltage is respectively raised in the first external compensation phase and the second external compensation phase is the mobility compensation voltage of the driving transistor DK and the amount of change in the threshold voltage of the driving transistor DK. That is, the mobility compensation voltage of the driving transistor DK and the amount of change in the threshold voltage of the driving transistor DK are compensated for in the first external compensation phase, and when the compensation on the mobility compensation voltage of the driving transistor DK and the amount of change in the threshold voltage of the driving transistor DK are not completed in the first external compensation phase, the mobility compensation voltage of the driving transistor DK and the amount of change in the threshold voltage of the driving transistor DK are further compensated for in the second external compensation phase until the compensation on the mobility compensation voltage of the driving transistor DK and the amount of change in the threshold voltage of the driving transistor DK are completed. It should be noted that, when the compensation on the mobility compensation voltage of the driving transistor DK and the amount of change in the threshold voltage of the driving transistor DK are completed in the first external compensation phase, the sum of the data signal Vdata and the threshold voltage Vth of the driving transistor DK is only converted in the second external compensation phase.

Figure 5:
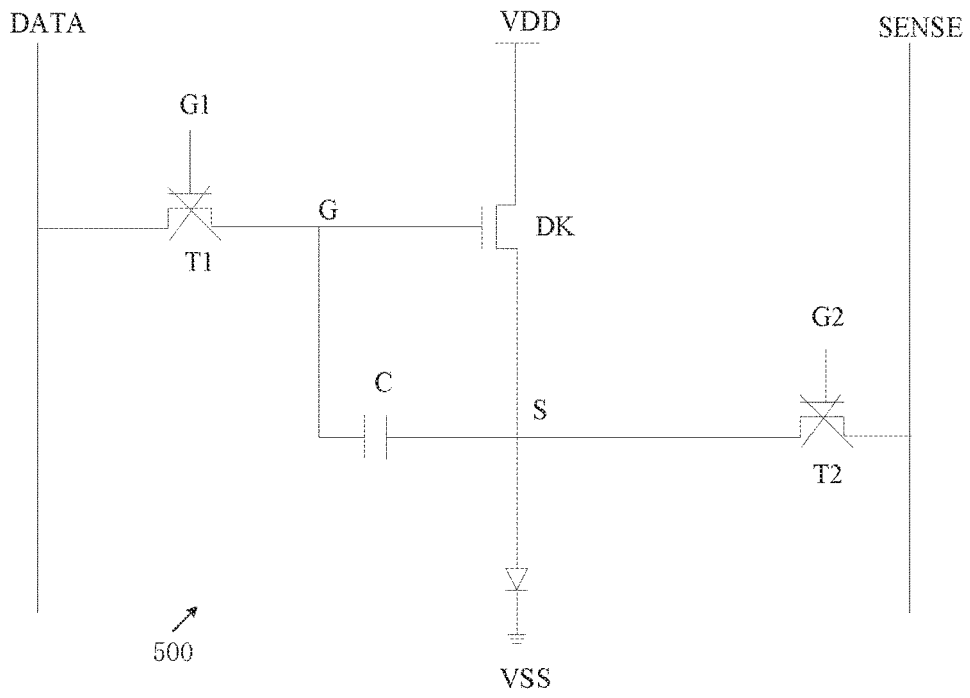
FIG. 5 is an equivalent circuit diagram of a 3T1C pixel circuit in an light emitting phase according to an example arrangement of the present disclosure.

In the light emitting phase of the pixel circuit (i.e., a phase t3), the driving transistor DK is turned on under the action of the data signal Vdata and the threshold voltage Vth of the driving transistor DK and the internal loss voltage, and outputs a driving current under the action of the first power signal VDD of the pixel circuit to drive the electroluminescent element to emit light. In the example arrangement of the present disclosure, the first scan signal G1 and the second scan signal G2 are both low level, as shown in 500 of FIG. 5, since the first switching transistor T1 and the second switching transistor T2 are both turned off. At this time, the voltage of the first terminal S of the driving transistor DK changes from $V_L$+ΔV to VSS+Voled, that is, the voltage of the first terminal S of the driving transistor DK changes by VSS+Voled−$V_L$−ΔV. Since the voltages on both sides of the capacitor cannot be changed abruptly, when the voltage of the first terminal S of the driving transistor DK changes by VSS+Voled−VL−ΔV, the voltage of the control terminal G of the driving transistor DK also changes by VSS+Voled−VL−ΔV, and at this time, the voltage of the control terminal G of the driving transistor DK is Vdata+Vth+VSS+Voled−VL−ΔV.

On this basis, according to the calculation formula of the driving current of the driving transistor DK:

$$
\begin{aligned}
Ion &= K \times (Vgs - Vth)^2 \\
&= K \times (Vg - Vs - Vth)^2 \\
&= \mu_n C_{ox} \frac{W}{L} \times (Vdata + Vth + VSS + Voled - \\
&\quad V_L - \Delta V - VSS - Voled - Vth)^2 \\
&= \mu_n C_{ox} \frac{W}{L} \times (Vdata - V_L - \Delta V)^2
\end{aligned}
$$

Where, Vgs is the voltage difference between the gate electrode and the source electrode of the driving transistor DK, Vg is the gate voltage of the driving transistor DK, and Vs is the source voltage of the driving transistor DK. $\mu_n$ is the mobility of the driving transistor DK, $C_{ox}$ is the capacitance per unit area of the gate oxide of the driving transistor DK, $$\frac{W}{L}$$

is the aspect ratio of the driving transistor DK, and Voled is the voltage of the electroluminescent element.

It can be seen from the calculation formula of the driving current of the driving transistor DK that the driving current of the driving transistor DK is independent of the threshold voltage Vth of the driving transistor DK, and since ΔV is the compensated internal loss voltage, it can avoid internal loss influencing the current of the driving transistor DK, and can ensure the uniformity of the brightness of each pixel display. In addition, since the internal loss and the threshold voltage Vth are both compensated for, the drive current has a larger current drive capability.

In the compensation phase, the threshold voltage Vth of the driving transistor DK for correcting the reference voltage and the data voltage is calculated in a sensing phase (not shown in FIG. 2) of the pixel circuit. Specifically, calculating the threshold voltage Vth of the driving transistor DK in a sensing phase of the pixel circuit can include three implementations.

Figure 6:
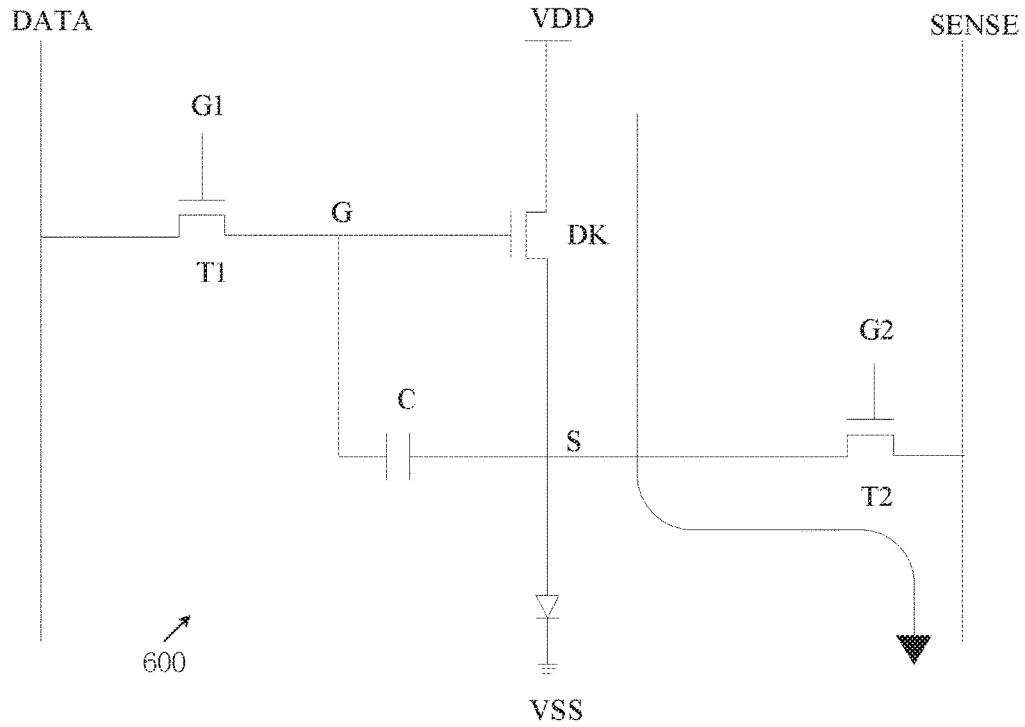
FIG. 6 is a schematic diagram of extracting a current signal flowing through a driving transistor according to an example arrangement of the present disclosure.

Implementation 1, in the sensing phase of the pixel circuit (not shown in FIG. 2), a current signal flowing through the driving transistor DK is extracted with the sensing line of the pixel circuit, and based on the current signal flowing through the driving transistor DK, the threshold voltage Vth of the driving transistor DK is calculated with an external electrical compensation circuit. In the example arrangement of the present disclosure, in the sensing phase, as shown in 600 of FIG. 6, the reset line SENSE is used as a sensing line, and a current signal flowing through the driving transistor DK is extracted through the reset line SENSE, and the extracted current signal through the driving transistor DK is transmitted to an external electrical compensation circuit that calculates the threshold voltage Vth of the driving transistor DK based on the current signal of the driving transistor DK. The arrow shown in FIG. 6 is the direction in which the current signal flowing through the driving transistor DK is extracted.

Figure 7:
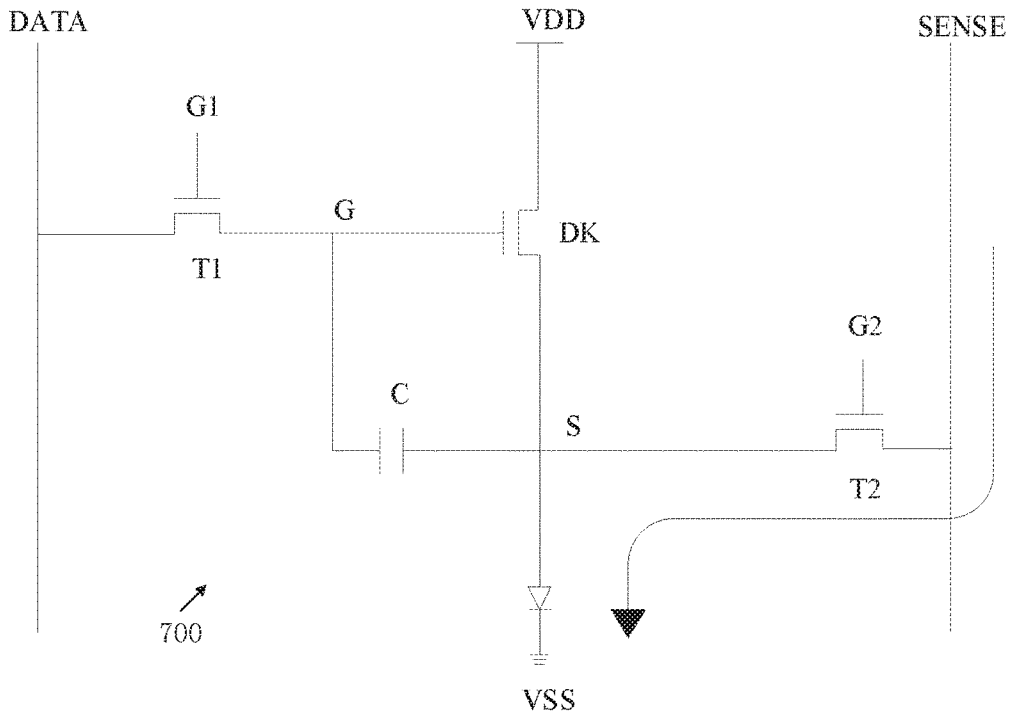
FIG. 7 is a schematic diagram of extracting a current signal flowing through an electroluminescent element according to an example arrangement of the present disclosure.

Implementation 2, in the sensing phase of the pixel circuit (not shown in FIG. 2), a current signal flowing through the electroluminescent element is extracted with the sensing line of the pixel circuit, and based on the current signal flowing through the electroluminescent element, the threshold voltage Vth of the driving transistor DK is calculated with an external electrical compensation circuit. In the example arrangement of the present disclosure, in the sensing phase, as shown in 700 of FIG. 7, the reset line SENSE is used as a sensing line, and a current signal flowing through the electroluminescent element is extracted through the reset line SENSE, and the extracted current signal through the electroluminescent element is transmitted to an external electrical compensation circuit that calculates the threshold voltage Vth of the driving transistor DK based on the current signal of the electroluminescent element. The arrow shown in FIG. 7 is the direction in which the current signal flowing through the electroluminescent element is extracted.

Figure 8:
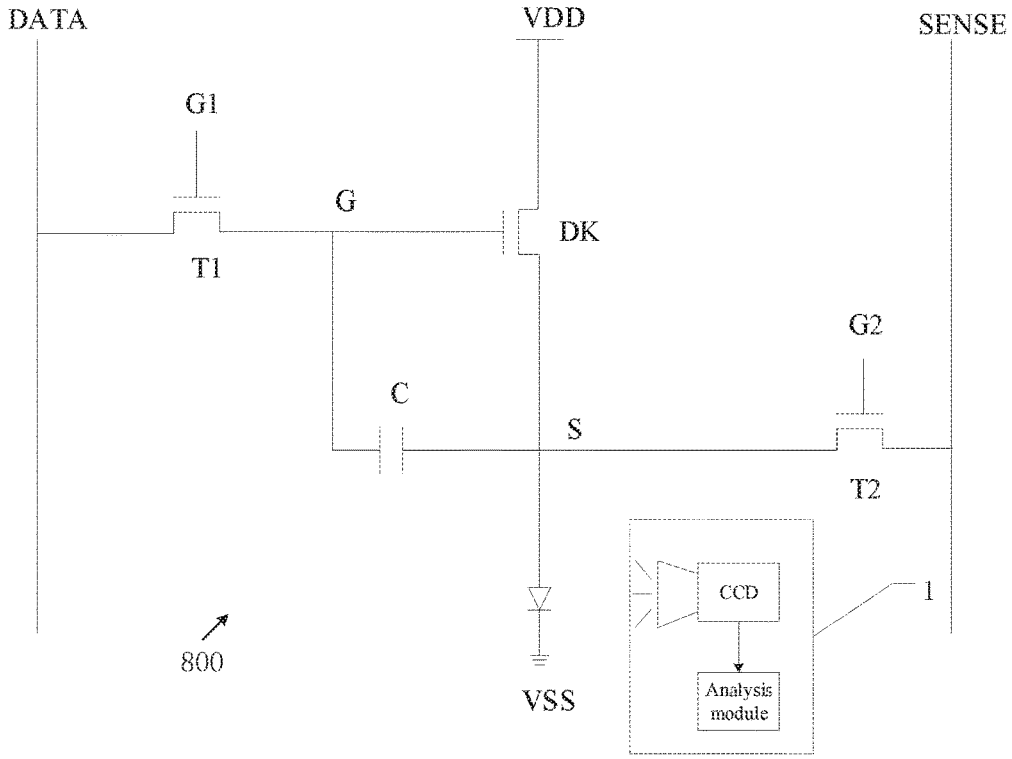
FIG. 8 is a schematic diagram of acquiring brightness values of an electroluminescent element by an external optical compensation circuit according to an example arrangement of the present disclosure.

Implementation 3, in the sensing phase of the pixel circuit (not shown in FIG. 2), the brightness value of the electroluminescent element is obtained with an external optical compensation circuit, and the threshold voltage Vth of the driving transistor DK is calculated according to the brightness value of the electroluminescent element. In the example arrangement of the present disclosure, as shown in 800 of FIG. 8, the electroluminescent element can be photographed by a CCD camera in the external optical compensation circuit 1, and the photographed image is analyzed to obtain the brightness value of the electroluminescent element, and then, the threshold voltage Vth of the driving transistor DK is calculated according to the brightness value in conjunction with the brightness-grayscale model of the electroluminescent element.

The example arrangement of the present disclosure also provides a driving method for a pixel circuit, for providing a preset signal to a control terminal of a driving transistor in a pixel circuit. The signal generating method may include block S810, and block S820.

In block S810, a reference signal and a data signal are provided.

In block S820, a preset signal is generated according to the reference signal, the data signal, and a threshold voltage of the driving transistor. In a first external compensation phase of the pixel circuit, the preset signal is a sum of the threshold voltage of the driving transistor and the reference signal, in a second external compensation phase of the pixel circuit, the preset signal is a sum of a threshold voltage of the driving transistor and the data signal.

In the example arrangement of the present disclosure, the reference signal and the data signal may be respectively corrected according to the threshold voltage of the driving transistor, so that the corrected voltage of the reference signal is the sum of the reference signal and the threshold voltages, the corrected voltage of the data signal is the sum of the data signal and the threshold voltage, and then the corrected reference signal or the corrected data signal may be gated according to each working phase of the pixel circuit, to generate a preset signal. That is, the corrected reference signal is gated in the first external compensation phase, and the corrected data signal is gated in the second external compensation phase.

The threshold voltage is obtained by obtaining a threshold voltage of the driving transistor from an external compensation circuit in a sensing phase of the pixel circuit. The external compensation circuit can include an external electrical compensation circuit and an external optical compensation circuit. Since the method of obtaining the threshold voltage of the driving transistor through the external compensation circuit has been described in detail in the above-described driving compensation method for a pixel circuit, which will not be repeated herein.

Accordingly, the preset signal is generated according to the reference signal, the data signal, and the threshold voltage of the driving transistor. In the first external compensation phase of the pixel circuit, the preset signal is the sum of the threshold voltage of the driving transistor and the reference signal, and in the second external compensation phase of the pixel circuit, the preset signal is the sum of the threshold voltage of the driving transistor and the data signal. On the one hand, since in the first external compensation phase, the preset signal is the sum of the reference signal and the threshold voltage of the driving transistor, and in the second external compensation phase, the preset signal is the sum of the data signal and the threshold voltage of the driving transistor, that is, the reference signal and the data signal are respectively corrected by the threshold voltage of the driving transistor, to write the threshold voltage of the driving transistor to the control terminal of the driving transistor through an external compensation manner, thus it can eliminate the influence of the threshold voltage of the driving transistor on the current of the driving transistor, and ensure the uniformity of the brightness of each pixel display. On the other hand, in the first external compensation phase, the voltage of the control terminal of the driving transistor maintains the sum of the reference signal and the threshold voltage of the driving transistor for a period of time, to raise the voltage of the first terminal of the driving transistor for the first time. When the second external compensation phase arrives, the voltage of the control terminal of the driving transistor is changed from the sum of the reference signal and the threshold voltage of the driving transistor to the sum of the data signal and the threshold voltage of the driving transistor, to raise the voltage of the first terminal of the driving transistor for the second time based on the raise of the first time. Therefore, during the entire compensation phase, the voltage of the first terminal of the driving transistor is raised twice. Thus the internal compensation range can be expanded, and the problem of insufficient charging time of the data signal can also be avoided. Lastly, in the compensation phase, through the sum of the reference signal provided to the control terminal of the driving transistor and the threshold voltage of the driving transistor and the sum of the data signal and the threshold voltages of the driving transistor, the internal loss voltage can be written to the first terminal of the driving transistor to eliminate the influence of internal loss on the current of the driving transistor, and ensure the uniformity of display brightness of each pixel.

Figure 9:
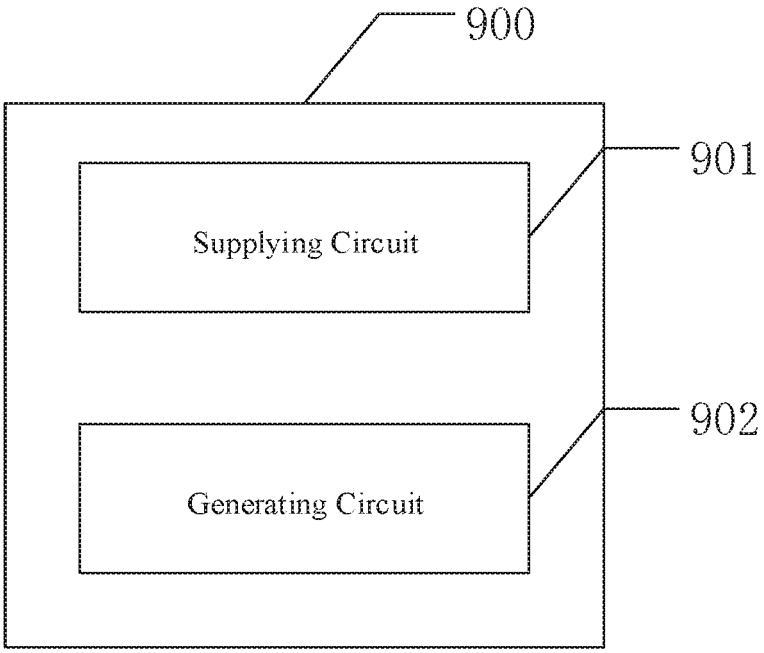
FIG. 9 is a block diagram of a driving device for a pixel circuit according to an example arrangement of the present disclosure.

An example arrangement also provides a driving device for a pixel circuit, for providing a preset signal to a control terminal of a driving transistor in a pixel circuit. As shown in FIG. 9, the driving device for a pixel circuit 900 may include: a supplying circuit 901 and a generating circuit 902.

The supplying circuit 901 can be configured to provide a reference signal and a data signal.

The generating circuit 902 can be configured to generate the preset signal according to the reference signal, the data signal, and the threshold voltage of the driving transistor. In the first external compensation phase of the pixel circuit, the preset signal is the sum of the threshold voltage of the driving transistor and the reference signal, and in the second external compensation phase of the pixel circuit, the preset signal is the sum of the threshold voltage of the driving transistor and the data signal.

It should be noted that each module of the driving device for a pixel circuit has been described in detail in the corresponding driving method for a pixel circuit, and therefore, no further description will be made herein.

An example arrangement of the present disclosure also provides a display device including the above-described driving device for a pixel circuit. The display device can keep the display brightness of the electroluminescent elements driven by the respective pixel circuits consistent, thus avoiding the occurrence of cross-color and splash screen phenomenon, thus improving the display image quality. In the example arrangement of the present disclosure, the display device may include any product or component having a display function, such as a mobile phone, a tablet computer, a television, a notebook computer, a digital photo frame, a navigator, and the like.

It should be noted that although several modules or units of devices for performing action are mentioned in the detailed description above, such division is not mandatory. Indeed, according to arrangements of the present disclosure, the features and functions of two or more modules or units described above may be embodied in one module or unit. Rather, the features and functions of one of the modules or units described above may be further divided into multiple modules or units.

In addition, although the various blocks of the method of the present disclosure are described in a particular order in the drawings, this is not required or implied that the blocks must be performed in the specific order, or all the blocks shown must be performed to achieve the desired result. Additionally or alternatively, certain blocks may be omitted, multiple blocks being combined into one block execution, and/or one block being decomposed into multiple block executions and the like.

The above is only specific arrangements of the present disclosure, but the scope of the present disclosure is not limited thereto, and any changes or substitutions easily contemplated by any person skilled in the art within the technical scope of the disclosure should be covered within the scope of protection of the present disclosure. Therefore, the scope of protection of the present disclosure should be subject to the scope of the claims.

What is claimed is:

1. A driving compensation method for a pixel circuit, the pixel circuit comprising a driving transistor, and the driving compensation method comprising:

in a compensation phase of the pixel circuit, providing a preset signal to a control terminal of the driving transistor to write the preset signal to a control terminal of the driving transistor, and writing an internal loss voltage of the driving transistor to a first terminal of the driving transistor, wherein:

the compensation phase comprises a first external compensation phase and a second external compensation phase;

in the first external compensation phase, the preset signal is a sum of a reference signal and a threshold voltage of the driving transistor;

in the second external compensation phase, the preset signal is a sum of a data signal and a threshold voltage of the driving transistor; and when the threshold voltage of the driving transistor changes between the first external compensation phase and the second external compensation phase, a mobility compensation voltage of the driving transistor and an amount of change in the threshold voltage of the driving transistor are determined as the internal loss voltage.

2. The driving compensation method for a pixel circuit according to claim 1, further comprising:

in a reset phase of the pixel circuit, providing the preset signal to the control terminal of the driving transistor to reset the control terminal of the driving transistor and providing a reset signal to the first terminal of the driving transistor to reset the first terminal of the driving transistor, wherein the preset signal is the sum of the reference signal and the threshold voltage of the driving transistor.

3. The driving compensation method for a pixel circuit according to claim 1, further comprising:

in a light emitting phase of the pixel circuit, the driving transistor being turned on under action of the data signal and the threshold voltage of the driving transistor and the internal loss voltage, outputting a driving current under action of a first power signal of the pixel circuit to drive an electroluminescent element to emit light.

4. The driving compensation method for a pixel circuit according to claim 1, further comprising:

in a sensing phase of the pixel circuit, extracting a current signal flowing through the driving transistor with a sensing line of the pixel circuit and, based on the current signal flowing through the driving transistor, calculating, by an external electrical compensation circuit, the threshold voltage of the driving transistor.

5. The driving compensation method for a pixel circuit according to claim 1, further comprising:

in a sensing phase of the pixel circuit, extracting a current signal flowing through the electroluminescent element with a sensing line of the pixel circuit, and based on the current signal flowing through the electroluminescent element, calculating the threshold voltage of the driving transistor with an external electrical compensation circuit.

6. The driving compensation method for a pixel circuit according to claim 1, further comprising:

in a sensing phase of the pixel circuit, obtaining, by an external electrical compensation circuit, a brightness value of an electroluminescent element, and calculating the threshold voltage of the driving transistor according to the brightness value of the electroluminescent element.

7. The driving compensation method for a pixel circuit according to claim 1, wherein when the threshold voltage of the driving transistor remains unchanged between the first external compensation phase and the second external compensation phase, a mobility compensation voltage of the driving transistor is determined as the internal loss voltage.

8. A driving method for a pixel circuit, for providing a preset signal to a control terminal of a driving transistor in a pixel circuit, and the method comprising:

providing a reference signal and a data signal; and generating the preset signal according to the reference signal, the data signal, and a threshold voltage of the driving transistor, wherein, in a first external compensation phase of the pixel circuit, the preset signal is a sum of the threshold voltage of the driving transistor and the reference signal, in a second external compensation phase of the pixel circuit, the preset signal is a sum of a threshold voltage of the driving transistor and the data signal; and wherein when the threshold voltage of the driving transistor changes between the first external compensation phase and the second external compensation phase, a mobility compensation voltage of the driving transistor and an amount of change in the threshold voltage of the driving transistor are determined as the internal loss voltage.

9. The driving method for a pixel circuit according to claim 8, further comprising: in a sensing phase of the pixel circuit, obtaining the threshold voltage of the driving transistor from an external compensation circuit.

10. The driving method for a pixel circuit according to claim 9, wherein the external compensation circuit comprises an external electrical compensation circuit and an external optical compensation circuit.

11. A driving device for a pixel circuit for providing a preset signal to a control terminal of a driving transistor in a pixel circuit, comprising:

a supplying circuit configured to provide a reference signal and a data signal; and a generating circuit configured to generate the preset signal according to the reference signal, the data signal, and a threshold voltage of the driving transistor, wherein:

in a first external compensation phase of the pixel circuit, the preset signal is a sum of the threshold voltage of the driving transistor and the reference signal, in a second external compensation phase of the pixel circuit, the preset signal is a sum of the threshold voltage of the driving transistor and the data signal, and when the threshold voltage of the driving transistor changes between the first external compensation phase and the second external compensation phase, a mobility compensation voltage of the driving transistor and an amount of change in the threshold voltage of the driving transistor are determined as the internal loss voltage.

12. The pixel circuit according to claim 11, wherein the pixel circuit is implemented in a display device.

* * * * *